US007486256B2

(12) United States Patent
Jung

(10) Patent No.: US 7,486,256 B2
(45) Date of Patent: Feb. 3, 2009

(54) ENERGY RECOVERING APPARATUS AND METHOD AND METHOD OF DRIVING PLASMA DISPLAY PANEL USING THE SAME

(75) Inventor: Yun Kwon Jung, Kumi-shi (KR)

(73) Assignee: LG Electronics, Inc., Seoul (KR)

( * ) Notice: Subject to any disclaimer, the term of this patent is extended or adjusted under 35 U.S.C. 154(b) by 617 days.

(21) Appl. No.: 10/864,332

(22) Filed: Jun. 10, 2004

(65) Prior Publication Data

US 2004/0263128 A1 Dec. 30, 2004

(30) Foreign Application Priority Data

Jun. 12, 2003 (KR) ..... 10-2003-0037867

(51) Int. Cl.
*G09G 3/28* (2006.01)

(52) U.S. Cl. ..... 345/60; 345/67; 315/169.1

(58) Field of Classification Search ..... 345/60–68; 315/169.1–169.4

See application file for complete search history.

(56) References Cited

U.S. PATENT DOCUMENTS

| | | | | |
|---|---|---|---|---|
| 6,111,556 | A | 8/2000 | Moon | |
| 6,175,192 | B1 | 1/2001 | Moon | 315/169.3 |
| 6,653,995 | B2 * | 11/2003 | Ho et al. | 345/60 |
| 6,768,270 | B2 * | 7/2004 | Chae | 315/169.3 |
| 6,784,858 | B2 * | 8/2004 | Awamoto | 345/60 |
| 6,850,213 | B2 * | 2/2005 | Marcotte | 345/60 |
| 7,176,851 | B2 * | 2/2007 | Shiokawa et al. | 345/60 |
| 2002/0196209 | A1 | 12/2002 | Ho et al. | 345/60 |
| 2003/0085886 | A1 | 5/2003 | Ide et al. | 345/211 |
| 2003/0137472 | A1 * | 7/2003 | Schermerhorn | 345/60 |
| 2003/0189534 | A1 * | 10/2003 | Myoung et al. | 345/67 |

FOREIGN PATENT DOCUMENTS

| | | |
|---|---|---|
| CN | 1203683 | 4/2003 |
| CN | 1417763 | 5/2003 |
| EP | 1 209 652 A2 | 5/2002 |
| EP | 1 280 124 A2 | 1/2003 |
| EP | 1 339 038 | 8/2003 |
| JP | 10-333635 | 12/1998 |
| WO | WO 00/14711 | 3/2000 |
| WO | WO 02/33690 A1 | 4/2002 |

OTHER PUBLICATIONS

European Search Report dated May 16, 2007.

* cited by examiner

*Primary Examiner*—Richard Hjerpe
*Assistant Examiner*—Kimnhung Nguyen
(74) *Attorney, Agent, or Firm*—Ked & Associates LLP

(57) ABSTRACT

An energy recovering apparatus for improving light-emission efficiency is disclosed. In the apparatus, a rectangular waveform supplier supplies a rectangular waveform to a panel capacitor. A tower waveform supplier supplies a tower waveform having any one shape of a sinusoidal waveform, a resonant waveform and a ripple waveform to the panel capacitor charged by said rectangular waveform.

16 Claims, 11 Drawing Sheets

ENERGY RECOVERING APPARATUS AND METHOD AND METHOD OF DRIVING PLASMA DISPLAY PANEL USING THE SAME

This application claims the benefit of Korean Patent Application No. P2003-37867 filed in Korea on Jun. 12, 2003, which is hereby incorporated by reference.

BACKGROUND OF THE INVENTION

1. Field of the Invention

This invention relates to a plasma display panel, and more particularly to an energy recovering apparatus and method and a method of driving a plasma display panel using the same that are adaptive for improving light-emission efficiency.

2. Description of the Related Art

Generally, a plasma display panel (PDP) radiates a phosphorous material using an ultraviolet ray with a wavelength of 147 nm generated upon discharge of an inactive mixture gas such as He+Xe, Ne+Xe or He+Ne+Xe, to thereby display a picture including characters and graphics. Such a PDP is easy to be made into a thin-film and large-dimension type. Moreover, the PDP provides a very improved picture quality owing to a recent technical development. Particularly, since a three-electrode, alternating current (AC) surface-discharge PDP has wall charges accumulated in the surface thereof upon discharge and protects electrodes from a sputtering generated by the discharge, it has advantages of a low-voltage driving and a long life.

FIG. 1 is a perspective view showing a discharge cell structure of a conventional plasma display panel.

Referring to FIG. 1, a discharge cell of the conventional three-electrode, AC surface-discharge PDP includes a scan electrode Y and a sustain electrode Z provided on an upper substrate 10, and an address electrode X provided on a lower substrate 18. The scan electrode Y and the sustain electrode Z include transparent electrodes 12Y and 12Z, and metal bus electrodes 13Y and 13Z having a smaller line width than the transparent electrodes 12Y and 12Z and provided at one edge of the transparent electrodes 12Y and 12Z, respectively.

The transparent electrodes 12Y and 12Z are usually formed from indium-tin-oxide (ITO) on the upper substrate 10. The metal bus electrodes 13Y and 13Z are usually formed from a metal such as chrome (Cr) on the transparent electrodes 12Y and 12Z to thereby reduce a voltage drop caused by the transparent electrodes 12Y and 12Z having a high resistance. On the upper substrate 10 provided with the scan electrode Y and the sustain electrode Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode X. The surfaces of the lower dielectric layer 22 and the barrier ribs 24 are coated with a phosphorous material layer 26. The address electrode X is formed in a direction crossing the scan electrode Y and the sustain electrode Z. The barrier rib 24 is formed in a stripe or lattice shape to thereby prevent an ultraviolet ray and a visible light generated by a discharge from being leaked to the adjacent cells. The phosphorous material layer 26 is excited by an ultraviolet ray generated during the plasma discharge to generate any one of red, green and blue visible light rays. An inactive mixture gas is injected into a discharge space defined between the upper/lower substrates 10 and 18 and the barrier rib 24.

Such a PDP is driven with being separated into a plurality of sub-fields. In each sub-field interval, a light-emission having a frequency proportional to a weighting value of video data is progressed to thereby make a gray level display. Each of the sub-fields is driven with being again divided into a reset period, an address period and a sustain period.

Herein, the reset period is a time interval for forming uniform wall charges on the discharge cell; the address period is a time interval for generating a selective address discharge depending upon a logical value of video data; and the sustain period is a time interval for sustaining a discharge from a discharge cell at which the address discharge has been generated.

The sustain discharge of the AC surface-discharge PDP driven as mentioned above requires a high voltage more than hundreds of volts. Accordingly, an energy recovering apparatus is used for the purpose of minimizing a driving power required for the sustain discharge. The energy recovering apparatus recovers a voltage between the scan electrode Y and the sustain electrode Z to uses the recovered voltage as a driving voltage upon the next discharge.

FIG. 2 shows an energy recovering apparatus provided at the scan electrode Y in order to recover a sustain discharge voltage. In real, the energy recovering apparatus also is symmetrically provided at the sustain electrode Z around a panel capacitor Cp.

Referring to FIG. 2, the conventional energy recovering apparatus includes an inductor L connected between a panel capacitor Cp and a source capacitor Cs, first and third switches S1 and S3 connected, in parallel, between the source capacitor Cs and the inductor L, diodes D5 and D6 connected between the first and third switches S1 and S3 and the inductor L, and second and fourth switches S2 and S4 connected, in parallel, between the panel capacitor Cp and the inductor L.

The panel capacitor Cp is to equivalently express a capacitance formed between the scan electrode Y and the sustain electrode Z. The second switch S2 is connected to a reference voltage source Vs while the fourth switch S4 is connected to a ground voltage source GND. The source capacitor Cs recovers and charges a voltage charged in the panel capacitor Cp upon sustain discharge and re-supply the charged voltage to the panel capacitor Cp.

To this end, the source capacitor Cs has a capacitance value capable of charging a voltage of Vs/2 corresponding to a half value of the reference voltage source Vs. The inductor L forms a resonance circuit along with the panel capacitor Cp. The first to fourth switches S1 to S4 control a current flow. The fifth and sixth diodes D5 and D6 prevent a current from flowing in a backward direction. Internal diodes D1 to D4 provided at the first to fourth switches S1 to S4, respectively also prevent a flow of backward current.

FIG. 3 is a timing diagram and a waveform diagram representing an on/off timing of the switches shown in FIG. 2 and an output waveform of the panel capacitor.

An operation procedure of the energy recovering apparatus will be described assuming that 0 volt has been charged in the panel capacitor Cp and a Vs/2 voltage has been charged in the source capacitor Cs prior to a T1 interval.

In a T1 interval, the first switch S1 is turned on, to thereby form a current path extending from the source capacitor Cs, via the first switch S1, the inductor L, into the panel capacitor Cp. If the current path is formed, then a Vs/2 voltage charged in the source capacitor Cs is applied to the panel capacitor Cp. At this time, a Vs voltage equal to twice the voltage of the source capacitor Cs is charged in the panel capacitor Cp because the inductor L and the panel capacitor Cp form a serial resonance circuit.

In a T2 interval, the second switch S2 is turned on. If the second switch S2 is turned on, then a voltage of the reference voltage source Vs is applied to the panel capacitor Cp. In other words, if the second switch S2 is turned on, then a voltage value of the reference voltage source Vs is applied to the panel capacitor Cp, thereby preventing the voltage value of the panel capacitor Cp from being dropped into less than a voltage of the reference voltage source Vs and thus making a stable generation of the sustain discharge. Herein, since a voltage of the panel capacitor Cp has risen until Vs in the T1 interval, a voltage value supplied from the exterior during the T2 interval can be minimized. In other words, power consumption can be reduced.

In a T3 interval, the first switch S1 is turned off. At this time, the panel capacitor Cp keeps a voltage of the reference voltage source Vs. In a T4 interval, the second switch S2 is turned off while the third switch S3 is turned on. If the third switch S3 is turned on, then a current path extending from the panel capacitor Cp, via the inductor L and the third switch S3, into the source capacitor Cs is formed to recover a voltage Vcp charged in the panel capacitor Cp into the source capacitor Cs. At this time, a Vs/2 voltage is charged in the source capacitor Cs.

In a T5 interval, the fourth switch S4 is turned on. If the fourth switch S4 is turned on, then a current path between the panel capacitor Cp and the ground voltage source GND is formed, thereby allowing a voltage of the panel capacitor Cp to drop into 0 volt. In a T6 interval, the third switch S3 is turned off. In real, an alternating current driving pulse supplied to the scan electrode Y and the sustain electrode Z has the T1 to T6 intervals repeated periodically.

More specifically, a rectangular waveform, as shown in FIG. 4, having a predetermined rising slope and a predetermined falling slope is alternately applied to the scan electrode Y and the sustain electrode Z during the sustain period to thereby cause a sustain discharge. However, an application of the rectangular waveform during the sustain period raises a problem of a low light-emission efficiency. In other words, if a sustain pulse having a rectangular waveform as shown in FIG. 4 is applied, then only once discharge is generated for a short time at an initial period of the sustaining pulse (or the rectangular waveform). Herein, since an amount of a generated light is in proportion to a discharge time (or period), the conventional PDP has a low light-emission efficiency.

In order to overcome such a problem, a method of applying a ramp pulse as a sustaining pulse as shown in FIG. 5 is disclosed in Korea Patent Laid-open Gazette No. 2001-000955.

Referring to FIG. 5, a sustaining pulse generated from another conventional energy recovering apparatus suddenly rises until approximately a voltage of the reference voltage source Vs and then slowly rises from the reference voltage Vs until a peak voltage Vr at a predetermined slope. Thereafter, the sustaining pulse suddenly falls from the peak voltage Vr into a voltage of the ground voltage source GND. Herein, a discharge is generated when the sustaining pulse rises from the reference voltage Vs into the peak voltage Vr at a predetermined slope after rising until approximately a voltage of the reference voltage source Vs and when the sustaining pulse falls from the peak voltage Vr into a voltage of the ground voltage source GND. In other words, the sustaining pulse generated from the energy recovering apparatus causes approximately three times discharge to thereby improve light-emission efficiency.

However, the energy recovering apparatus as shown in FIG. 5 has a drawback in that, since it uses a ramp pulse, power consumption is wasted. More specifically, a ramp pulse rising slowly at a predetermined slope is generated by utilizing a resistor R. Accordingly, another conventional embodiment raises a problem in that an additional power consumption is wasted due to the resistor R.

Furthermore, the energy recovering apparatus shown in FIG. 5 generates a self-erasing discharge when the sustaining pulse falls from the peak voltage Vr into a voltage of the ground voltage source GND. If the self-erasing discharge is generated, then wall charges formed at the discharge cell are erased. In this case, as the wall charges formed at the discharge cell are erased, a sustain discharge is not generated when the next sustaining pulse is applied. In other words, when a wall voltage of the wall charges formed at the discharge cell is added to a voltage of the sustaining pulse to thereby cause a voltage difference more than a firing voltage between two electrodes, a stable sustain discharge can be generated. Thus, if wall charges formed at the discharge cell are erased, then a voltage difference between two electrodes becomes lower than the firing voltage, so that a sustain discharge is not generated.

SUMMARY OF THE INVENTION

Accordingly, it is an object of the present invention to provide an energy recovering apparatus and method and a method of driving a plasma display panel using the same that are adaptive for improving light-emission efficiency.

In order to achieve these and other objects of the invention, an energy recovering apparatus according to one aspect of the present invention includes a rectangular waveform supplier for supplying a rectangular waveform to a panel capacitor; and a tower waveform supplier for supplying a tower waveform having any one shape of a sinusoidal waveform, a resonant waveform and a ripple waveform to the panel capacitor charged by said rectangular waveform.

In the energy recovering apparatus, the tower waveform rises from a peak voltage of said rectangular waveform.

Otherwise, the tower waveform falls from a peak voltage of said rectangular waveform.

The tower waveform has a period of at least ¼ in said rectangular waveform.

The rectangular waveform supplier includes a first switch forming a charge path for applying a voltage charged in a source capacitor to the panel capacitor; a second switch forming a recovery path for recovering a voltage charged in the panel capacitor into the source capacitor; a first inductor provided at the charge path and the recovery path to form a resonance circuit along with the panel capacitor; a third switch for supplying a voltage of a reference voltage source to the panel capacitor after a voltage from the source capacitor was charged in the panel capacitor; and a fourth switch for connecting the panel capacitor to a ground voltage source.

Herein, said voltage of the reference voltage source is set to a voltage that does not cause a discharge at the panel capacitor even though it is applied to the panel capacitor.

The tower waveform supplier includes a tower waveform voltage source, connected between the reference voltage source and the panel capacitor; fifth and sixth switches connected between the tower waveform voltage source and the panel capacitor; and a second inductor, being connected between the sixth switch and the panel capacitor, for forming a resonance circuit along with the panel capacitor.

Herein, a voltage of the tower waveform voltage source is lower than that of the reference voltage source.

An inductance of the second inductor is higher than that of the first inductor.

The fifth and sixth switches are turned on when said voltage of the reference voltage source is applied to a negative terminal of the tower waveform voltage source.

When said tower waveform from the tower waveform supplier is supplied to the panel capacitor, a discharge is generated at the panel capacitor.

The energy recovering apparatus further includes a diode connected to the reference voltage source, the third switch and the tower waveform voltage source.

An energy recovering method according to another aspect of the present invention includes the steps of supplying a voltage rising until a first voltage to a panel capacitor; keeping a voltage of the panel capacitor at said first voltage; supplying a tower waveform rising from said first voltage until a second voltage and falling from said second voltage until said first voltage; and supplying a ground voltage to the panel capacitor.

Herein, the panel capacitor is discharged when said tower waveform is being supplied.

A method of driving a plasma display panel, having a reset period, an address period and a sustain period, according to still another aspect of the present invention includes the steps of initializing a discharge cell during the reset period; selecting a discharge cell to be turned on during the address period; and supplying a rectangular waveform and a tower waveform having any one shape of a sinusoidal waveform, a resonant waveform and a ripple waveform rising from a peak voltage of said rectangular waveform to induce a discharge of the discharge cell.

Herein, the discharge cell is discharged when said tower waveform is being supplied.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 6:
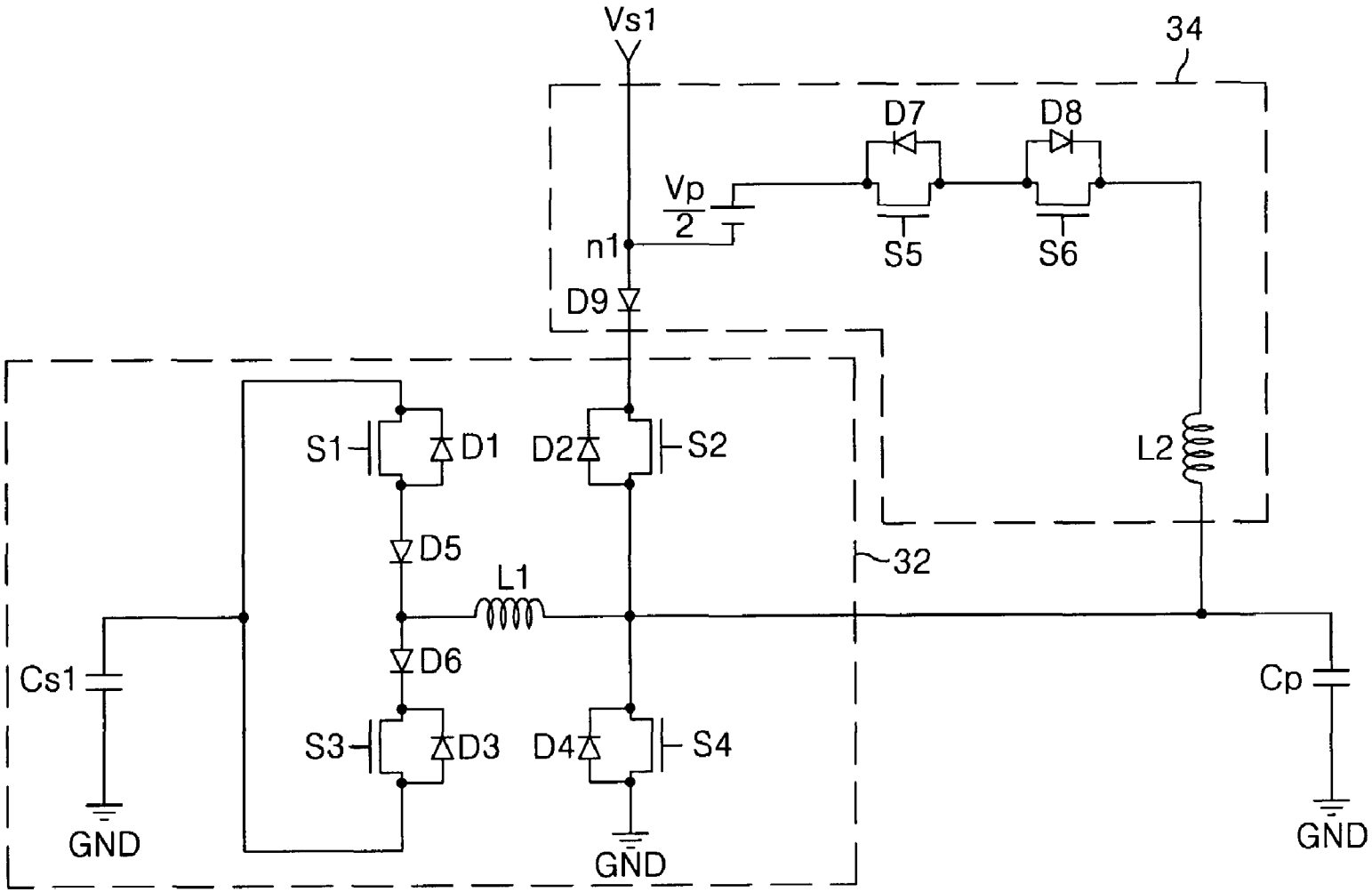
FIG. 6 is a circuit diagram of an energy recovering apparatus according to an embodiment of the present invention.

FIG. 6 is a circuit diagram representing an energy recovering apparatus provided at a scan electrode Y according to an embodiment of the present invention. This energy recovering apparatus also is symmetrically provided at a sustain electrode Z around a panel capacitor Cp. FIG. 7 represents a voltage of the panel capacitor Cp charged and discharged by a waveform supplied from the energy recovering apparatus shown in FIG. 6.

Referring to FIG. 6 and FIG. 7, the energy recovering apparatus according to the embodiment of the present invention includes a rectangular waveform supplier 32 for supplying a rectangular waveform to one side electrode of the panel capacitor Cp, and a tower waveform supplier 34 for supplying a sinusoidal waveform or a resonant waveform at a peak voltage of the rectangular waveform.

The panel capacitor Cp is to equivalently express a capacitance formed between the scan electrode Y and the sustain electrode Z.

Figure 1:
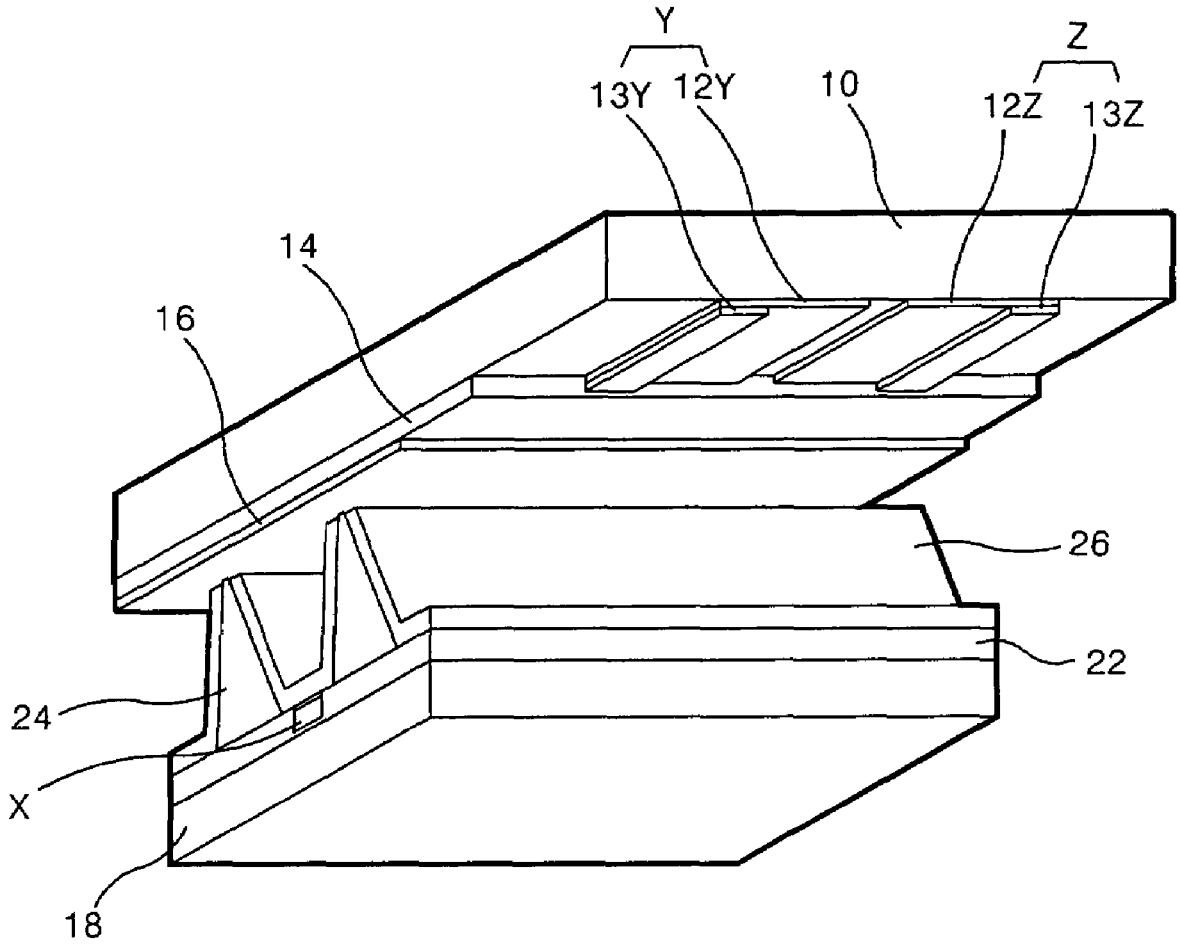
FIG. 1 RELATED ART
FIG. 1 is a perspective view showing a discharge cell structure of a conventional three-electrode AC surface-discharge plasma display panel.
Figure 2:
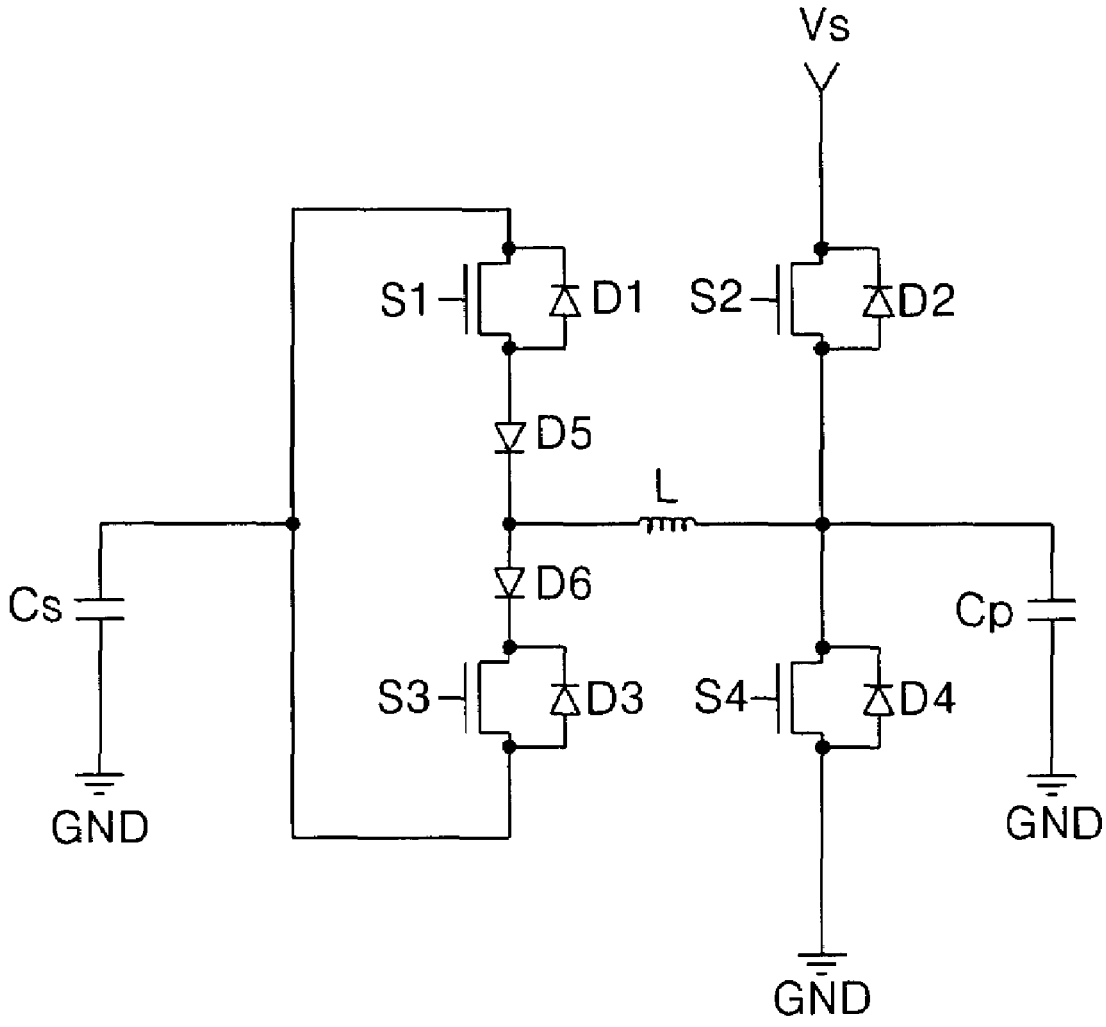
FIG. 2 RELATED ART
FIG. 2 is a circuit diagram of a conventional energy recovering apparatus.
Figure 3:
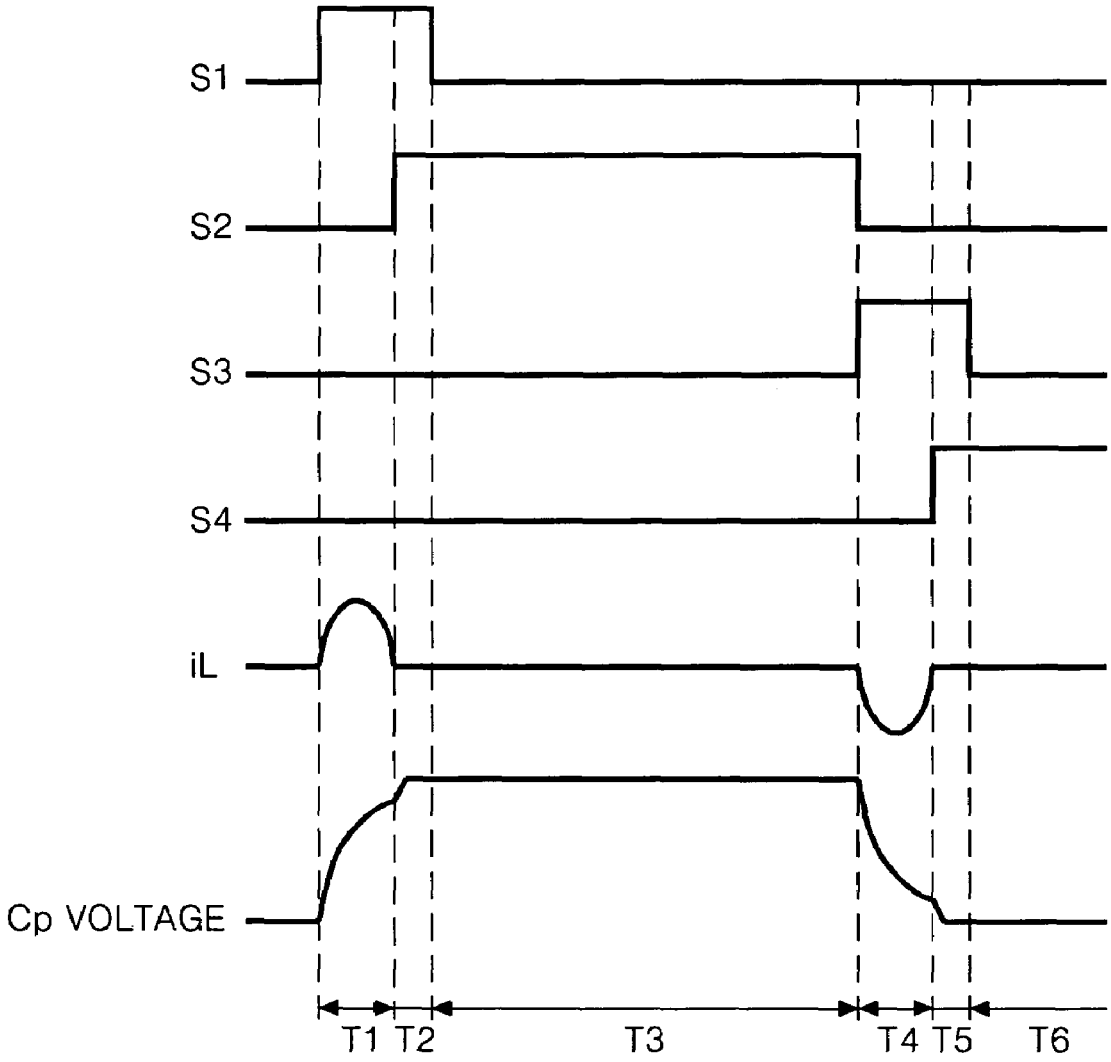
FIG.3 RELATED ART
FIG. 3 is a timing diagram representing an operation procedure of the energy recovering apparatus shown in FIG. 2.
Figure 4:
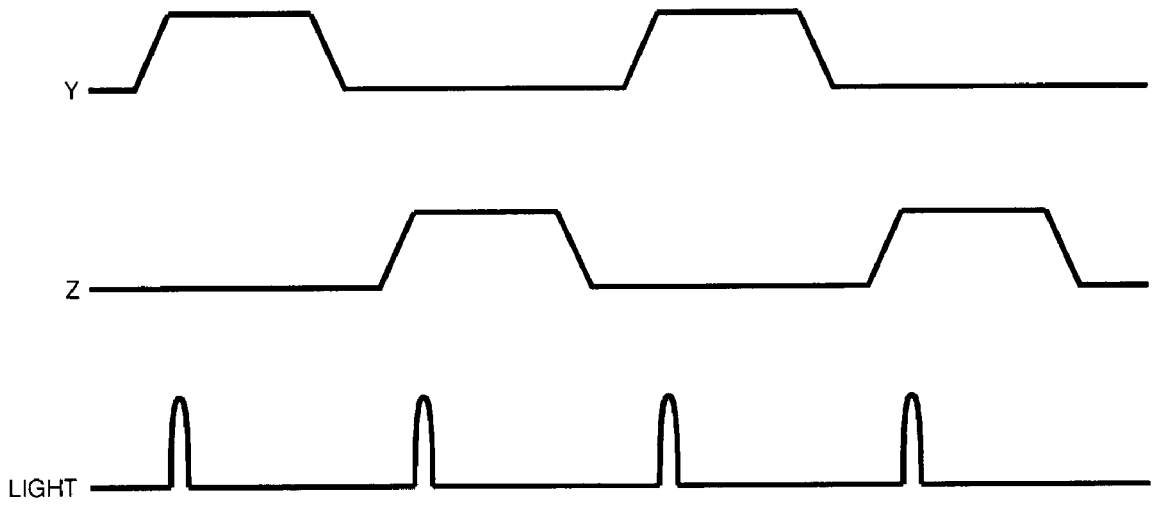
FIG. 4 RELATED ART
FIG. 4 illustrates a sustaining pulse supplied by the energy recovering apparatus shown in FIG. 2.
Figure 5:
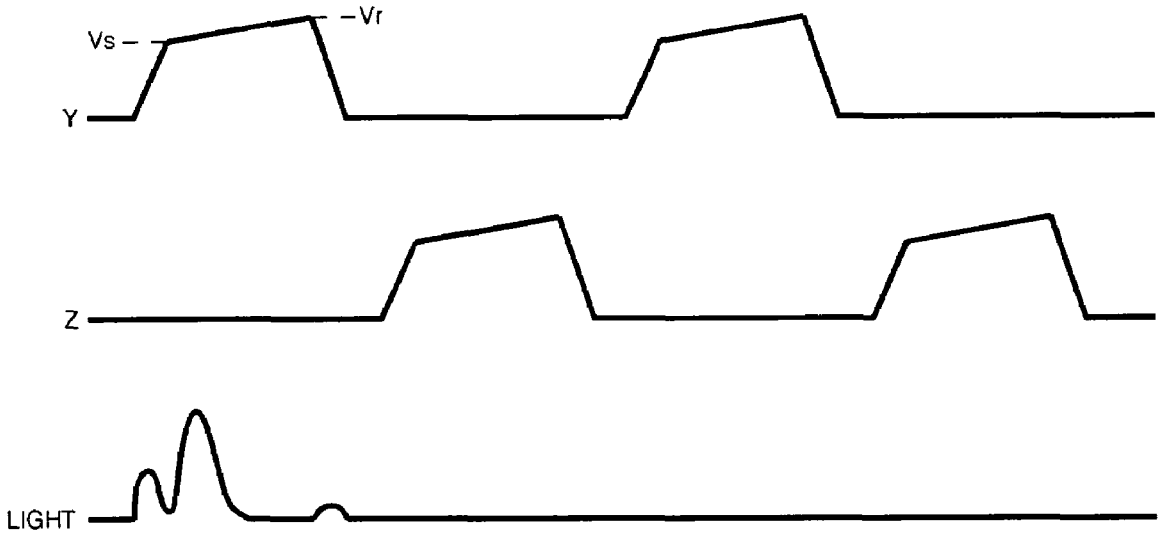
FIG. 5 RELATED ART
FIG. 5 illustrates a sustaining pulse supplied by another energy recovering apparatus.

The rectangular waveform supplier 32 has a circuit configuration substantially identical to the energy recovering apparatus shown in FIG. 2. The rectangular waveform supplier 32 charges the panel capacitor Cp using an LC serial resonant waveform generated by a serial connection of an inductor L1 with the panel capacitor Cp, and then keeps a voltage of the panel capacitor Cp at a reference voltage Vs1 and recovers a reactive power having not contributed to a discharge after discharging of the panel capacitor Cp into a source capacitor Cs1. Thus, the rectangular waveform supplier 32 generates a rectangular waveform 71 rising until the reference voltage Vs1.

A circuit configuration and an operation procedure of the rectangular waveform supplier 52 will be described below.

The rectangular waveform supplier 32 includes a first inductor L1 connected between the panel capacitor Cp and the source capacitor Cs1, first and third switches S1 and S3 connected, in parallel, between the source capacitor Cs1 and the first inductor L1, diodes D5 and D6 connected between the first and third switches S1 and S3 and the first inductor L1, and second and fourth switches S2 and S4 connected, in parallel, between the panel capacitor Cp and the first inductor L1.

The second switch S2 is connected to a reference voltage source Vs1 while the fourth switch S4 is connected to a ground voltage source GND. Herein, a voltage value of the reference voltage source Vs1 is set to be lower than Vs in the prior art. Thus, even though the voltage value of the reference voltage source Vs1 is applied to a discharge cell at which an address discharge is generated, a voltage value of the discharge cell is set to be less than a firing voltage to thereby prevent a generation of sustain discharge. The source capacitor Cs1 recovers and charges a voltage charged in the panel capacitor Cp upon sustain discharge and re-supply the charged voltage to the panel capacitor Cp.

To this end, the source capacitor Cs1 has a capacitance value capable of charging a voltage of Vs1/2 corresponding to a half value of the reference voltage source Vs1. The first inductor L1 forms a resonance circuit along with the panel capacitor Cp. The first to fourth switches S1 to S4 control a current flow. The fifth and sixth diodes D5 and D6 prevent a current from flowing in a backward direction. Internal diodes D1 to D4 provided at the first to fourth switches S1 to S4, respectively also prevent a flow of backward current.

The tower waveform supplier 34 is connected to the second switch S2 of the rectangular waveform supplier 32, the reference voltage source Vs1 and the panel capacitor Cp.

Figure 7A:
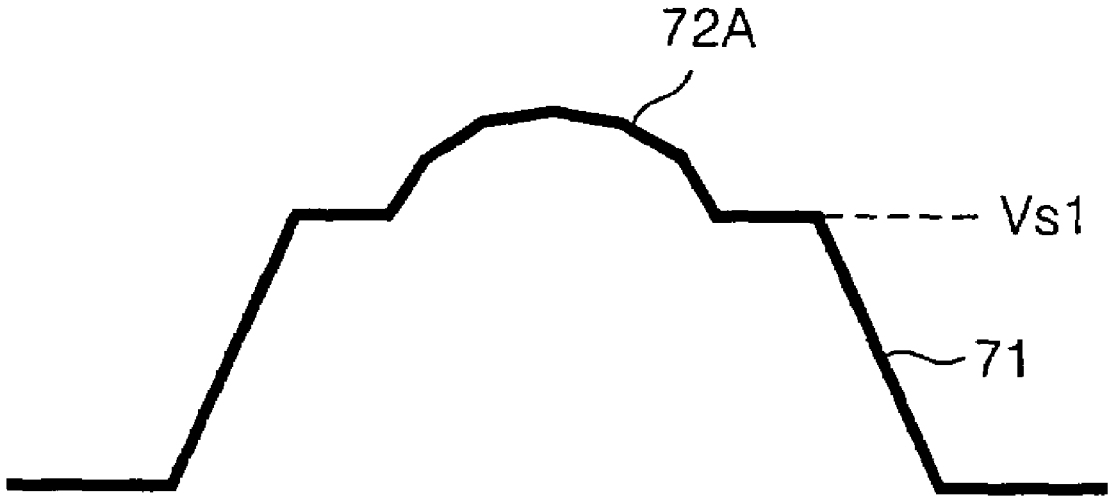
FIG. 7A to FIG. 7C are waveform diagrams representing tower waveforms generated from the energy recovering apparatus shown in FIG. 6.
Figure 7B:
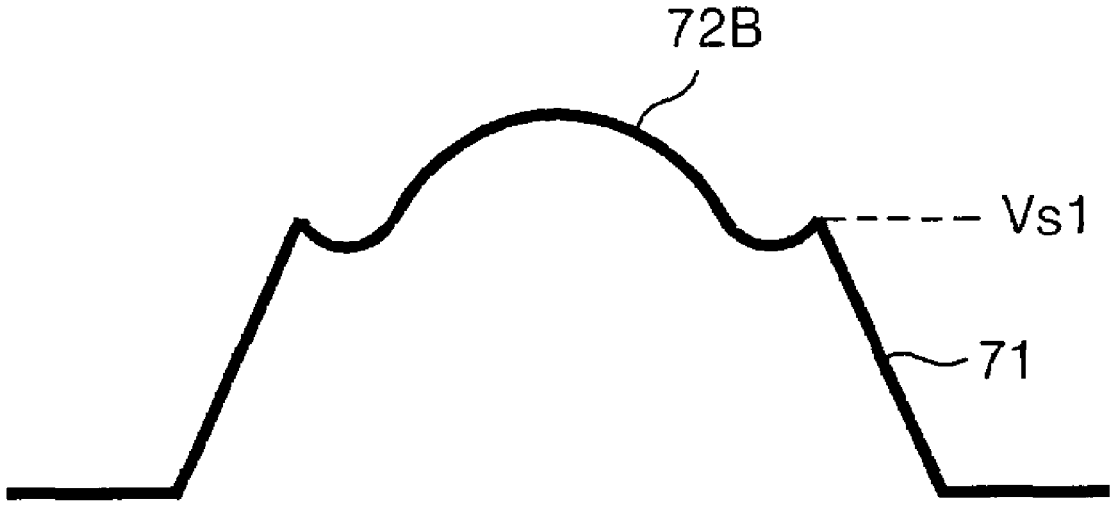
Figure 7C:
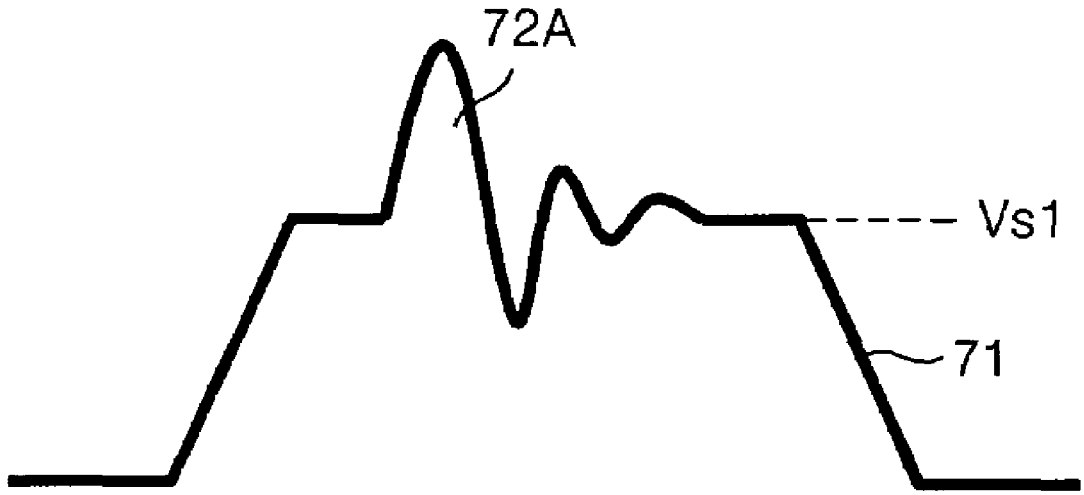

The tower waveform supplier 34 generates tower waveforms 72A, 72B and 72C, such as a sinusoidal waveform or a resonant waveform 72A or 72B as shown in FIG. 7A or FIG. 7B or a ripple waveform as shown in FIG. 7C, at a peak voltage, that is, a reference voltage Vs1 of the rectangular waveform 71 generated from the rectangular waveform supplier 32, and applies the tower waveforms 72A, 72B and 72C to the panel capacitor Cp. Shapes of the tower waveforms 72A, 72B and 72C can be changed in accordance with a capacitance variation of the panel capacitor Cp or an impedance variation of the energy recovering apparatus according to the embodiment of the present invention and the panel capacitor Cp.

Such a tower waveform supplier 34 further includes a ninth diode D9 connected, in series, between the reference voltage source Vs1 and the panel capacitor Cp, and a tower waveform voltage source Vp/2, a fifth switch S5, a sixth switch S6 and a second inductor L2 that are connected, in series, between a first node n1 connected to the reference voltage source Vs1 and the panel capacitor Cp.

The ninth diode D9 is connected between the first node to which the reference voltage source Vs1 and the tower waveform voltage source Vp/2 and the second switch S2 to shut off a backward current flowing from the second switch S2 into the first node n1.

The tower waveform voltage source Vp/2 applies a voltage to the second inductor L2 when the fifth and sixth switches S5 and S6 are turned on. Herein, a voltage of the tower waveform voltage source Vp/2 is lower than that of the reference voltage source Vs1.

The second inductor L2 forms a serial resonance circuit along with the panel capacitor Cp. In other words, the second inductor L2 allows a tower waveform such as a sinusoidal waveform, a resonant waveform or a ripple waveform to be applied to the panel capacitor Cp while making a resonance with the panel capacitor Cp when a voltage is supplied from the tower waveform voltage source Vp/2. It is preferable that, as slopes of the tower waveforms 72A, 72B and 72C go smaller, an inductance of the second inductor L2 becomes higher than that of the first inductor L1.

The fifth and sixth switches S5 and S6 are simultaneously turned on and off to thereby control a current flow between the tower waveform supplier Vp/2 and the second inductor L2. In this case, the fifth and sixth switches S5 and S6 are connected to internal diodes D7 and D9 having directions of an anode terminal and a cathode terminal opposite to each other, respectively for the purpose of shutting off a flow of backward current upon charging and discharging of the panel capacitor Cp. In other words, the cathode terminal of the seventh diode D7 is connected to the tower waveform voltage source Vp/2 while the anode terminal of the seventh diode D7 is connected to an anode terminal of the eighth diode D8 connected to the sixth switch S6. The cathode terminal of the sixth switch S6 is connected to the second inductor L2.

Figure 8:
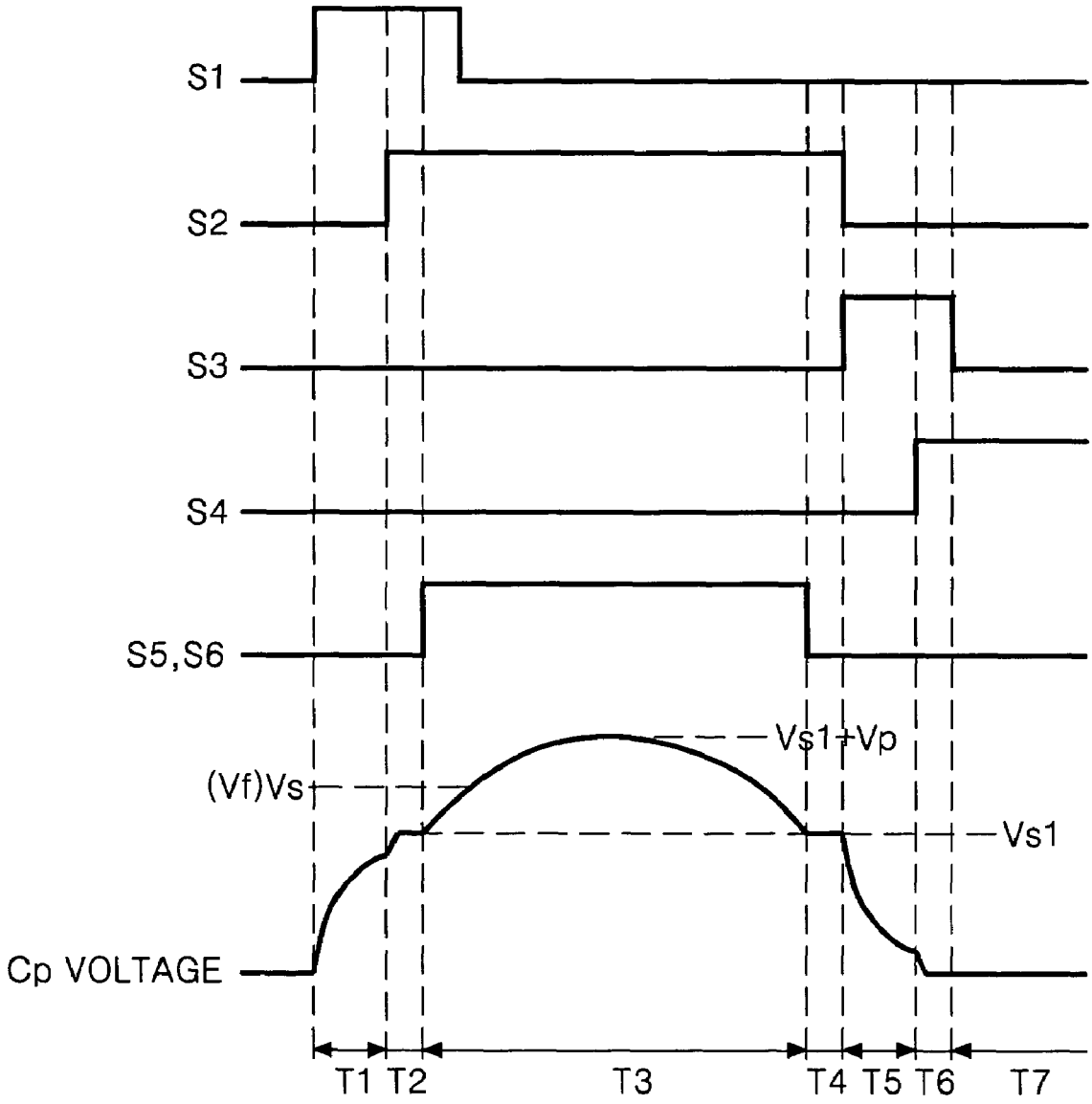
FIG. 8 is a timing diagram representing an operation procedure of the energy recovering apparatus shown in FIG. 6.

FIG. 8 is a timing diagram and a waveform diagram representing an on/off timing of the switches shown in FIG. 6 and an output waveform of the panel capacitor.

In FIG. 8, an operation procedure of the energy recovering apparatus will be described in detail assuming that 0 volt has been charged in the panel capacitor Cp and a Vs1/2 voltage has been charged in the source capacitor Cs prior to a T1 interval.

In a T1 interval, the first switch S1 is turned on, to thereby form a current path extending from the source capacitor Cs1, via the first switch S1, the first inductor L1, into the panel capacitor Cp. If the current path is formed, then a Vs1/2 voltage charged in the source capacitor Cs1 is applied to the panel capacitor Cp. At this time, a Vs1 voltage equal to approximately twice the voltage of the source capacitor Cs1 is charged in the panel capacitor Cp because the first inductor L1 and the panel capacitor Cp form a serial resonance circuit.

In a T2 interval, the second switch S2 is turned on. If the second switch S2 is turned on, then a voltage value of the reference voltage source Vs1 is applied to the panel capacitor Cp to thereby prevent a voltage value of the panel capacitor Cp from being dropped into less than a voltage value of the reference voltage source Vs1. Meanwhile, a voltage value of the reference voltage source Vs1 is set to be lower than Vs in the prior art, so that a sum of wall charges formed at the panel capacitor Cp with the voltage value of the reference voltage source Vs1 fails to go beyond a firing voltage. Thus, during the T2 interval, a sustain discharge is not generated at the discharge cell (or the panel capacitor Cp).

In a T3 interval, the fifth and sixth switches S5 and S6 are turned on. If the fifth and sixth switches S5 and S6 are turned on, then a voltage of the tower waveform voltage source Vp/2 is applied, via the fifth switch S5, the sixth switch S6 and the second inductor L2, to the panel capacitor Cp. At this time, since the second inductor L2 forms a serial resonance circuit along with the panel capacitor Cp, tower waveforms 72A, 72B and 72C rising and falling from a voltage of Vs1 into a voltage of Vs1+Vp are applied to the panel capacitor Cp.

More specifically, a reference voltage Vs1 is applied to the first node n1. Herein, the reference voltage Vs1 applied to the first node n1 is supplied to a negative terminal of the tower waveform voltage source Vp/2. Thus, the tower waveforms 72A, 72B and 72C supplied to the panel capacitor Cp are resonated from the reference voltage Vs1 that is a peak voltage of the rectangular waveform 71. In other words, the tower waveforms 72A, 72B and 72C supplied to the panel capacitor Cp rise from the reference voltage Vs1 and fall into the reference voltage Vs1. Specifically, the tower waveforms 72A, 72B and 72C are supplied to the panel capacitor Cp while rising from the reference voltage Vs1 until a voltage of Vs1+Vp and falling from a voltage of Vs1+Vp until the reference voltage Vs1. Meanwhile, the panel capacitor Cp having received the tower waveforms 72A, 72B and 72C is charged into a voltage more than a firing voltage Vf in the T2 interval. As a result, the panel capacitor Cp causes a sustain discharge. On the other hand, during the T2 interval, the first switch S1 is turned off.

In a T4 interval, the fifth and sixth switches S5 and S6 are turned off. If the fifth and sixth switches S5 and S6 are turned off, then the panel capacitor Cp keeps a voltage value of the reference voltage source Vs1. In a T5 interval, the second switch S2 is turned off while the third switch S32 is turned on. If the third switch S3 is turned on, then a current path extending from the panel capacitor Cp, via the first inductor L1 and the third switch S3, into the source capacitor Cs1 is formed to thereby recover a voltage charged in the panel capacitor Cp into the source capacitor Cs1. At this time, a voltage Vs1/2 is charged in the source capacitor Cs1.

In a T6 interval, the fourth switch S4 is turned on. If the fourth switch S4 is turned on, then a current path between the panel capacitor Cp and the ground voltage source GND is formed, thereby allowing a voltage of the panel capacitor Cp to be dropped into 0 volt. In a T7 interval, the third switch S3 is turned off. In real, an alternating current driving pulse supplied to the scan electrode Y and the sustain electrode Z has the T1 to T7 intervals repeated periodically.

Figure 9:
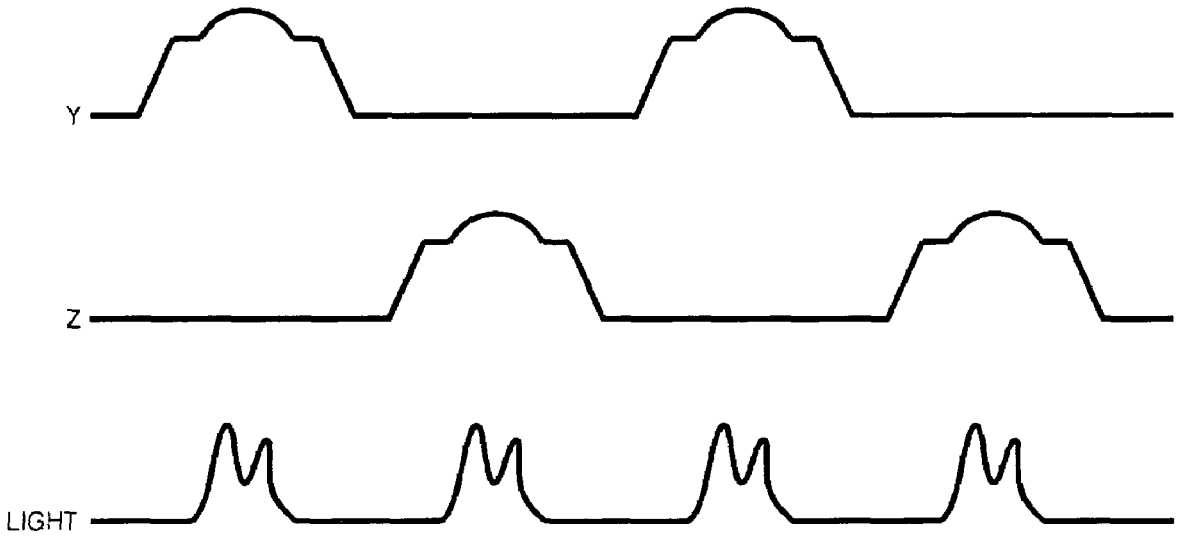
FIG. 9 illustrates a sustaining pulse supplied by the energy recovering apparatus shown in FIG. 6.

The tower waveforms 72A, 72B and 72C generated from the energy recovering apparatus according to the embodiment of the present invention are supplied at a peak voltage of the rectangular waveform 71. The tower waveforms 72A, 72B and 72C charge the panel capacitor Cp into a shape of a sinusoidal waveform, a resonant waveform or a ripple waveform at a predetermined slope as shown in FIG. 9, and allows the panel capacitor Cp to sustain a sustain discharge for a long time or to cause several times sustain discharges within a pulse width of the rectangular waveform 71.

Accordingly, the energy recovering apparatus according to the embodiment of the present invention can improve light-emission efficiency of the PDP. Furthermore, it can reduce power consumption because the tower waveforms 72A, 72B and 72C are produced by the second inductor L2 and the panel capacitor Cp, that is, because any resistor is not used. Moreover, the sustaining pulse generated from the energy recovering apparatus according to the embodiment of the present invention falls from a voltage value of the reference voltage source Vs into a voltage value of the ground voltage source GND, so that a self-erasing discharge is not generated. As a result, a sustain discharge can be stabilized.

Meanwhile, the tower waveforms 72A, 72B and 72C generated from the energy recovering apparatus according to the embodiment of the present invention have a period more than ¼ within a pulse width of the rectangular waveform 71.

As described above, according to the present invention, a sinusoidal waveform is applied at a maximum voltage of the rectangular waveform, so that it becomes possible to improve light-emission efficiency.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An energy recovering apparatus, comprising:

a rectangular waveform supplier for supplying a rectangular waveform to a panel capacitor; and a tower waveform supplier for supplying a tower waveform having any one of a shape of a sinusoidal waveform, a resonant waveform or a ripple waveform to the panel capacitor charged by said rectangular waveform, wherein after a voltage level of the rectangular waveform remains substantially constant at a reference voltage for a first predetermined period of time, the tower waveform of the tower waveform supplier is supplied to the panel capacitor with the rectangular waveform for a second predetermined period of time to form a combined waveform, the tower waveform causing the combined waveform to have at least one voltage value greater than the reference voltage at which the rectangular waveform is held substantially constant.

2. The energy recovering apparatus as claimed in claim 1, wherein, in the combined waveform, the tower waveform rises from the reference voltage which corresponds to a peak voltage of said rectangular waveform.

3. The energy recovering apparatus as claimed in claim 1, wherein, in the combined waveform, the tower waveform falls from the reference voltage which corresponds to a peak voltage of said rectangular waveform.

4. The energy recovering apparatus as claimed in claim 1, wherein the tower waveform has a period of at least ¼ in said rectangular waveform.

5. The energy recovering apparatus as claimed in claim 1, wherein, when said tower waveform from the tower waveform supplier is supplied to the panel capacitor, a discharge is generated at the panel capacitor.

a rectangular waveform supplier for supplying a rectangular

6. An energy recovering apparatus, comprising: waveform to a panel capacitor; and a tower waveform supplier for supplying a tower waveform having any one of a shape of a sinusoidal waveform, a resonant waveform or a ripple waveform to the panel capacitor charged by said rectangular waveform, wherein the rectangular waveform supplier includes:

a first switch forming a charge path for applying a voltage charged in a source capacitor to the panel capacitor;

a second switch forming a recovery path for recovering a voltage charged in the panel capacitor into the source capacitor;

a first inductor provided at the charge path and the recovery path to form a resonance circuit along with the panel capacitor;

a third switch for supplying a voltage of a reference voltage source to the panel capacitor after a voltage from the source capacitor was charged in the panel capacitor; and a fourth switch for connecting the panel capacitor to a ground voltage source.

7. The energy recovering apparatus as claimed in claim 6, wherein said voltage of the reference voltage source is set to a voltage that does not cause a discharge at the panel capacitor even though it is applied to the panel capacitor.

8. The energy recovering apparatus as claimed in claim 6, wherein the tower waveform supplier includes:

a tower waveform voltage source connected between the reference voltage source and the panel capacitor;

fifth and sixth switches connected between the tower waveform voltage source and the panel capacitor; and a second inductor, being connected between the sixth switch and the panel capacitor, for forming a resonance circuit along with the panel capacitor.

9. The energy recovering apparatus as claimed in claim 8, wherein a voltage of the tower waveform voltage source is lower than that of the reference voltage source.

10. The energy recovering apparatus as claimed in claim 7, wherein the fifth and sixth switches are turned on when said voltage of the reference voltage source is applied to a negative terminal of the tower waveform voltage source.

11. The energy recovering apparatus as claimed in claim 8, wherein an inductance of the second inductor is higher than that of the first inductor.

12. The energy recovering apparatus as claimed in claim 8, further comprising: a diode connected to the reference voltage source, the third switch and the tower waveform voltage source.

13. An energy recovering method, comprising: supplying a voltage which rises to a first voltage to a panel capacitor; keeping a voltage of the panel capacitor at said first voltage; supplying a tower waveform rising from said first voltage until a second voltage and falling from said second voltage to said first voltage; and supplying a ground voltage to the panel capacitor, wherein after the first voltage remains substantially constant at a reference voltage for a first predetermined period of time, the tower waveform is supplied to the panel capacitor for a second predetermined period of time to form a combined waveform, the tower waveform causing the combined waveform to have at least one voltage value greater than the reference voltage at which the rectangular waveform is held substantially constant.

14. The energy recovering method as claimed in claim 13, wherein the panel capacitor is discharged when said tower waveform is being supplied.

15. A method of driving a plasma display panel having a reset period, an address period and a sustain period, said method comprising:

initializing a discharge cell during the reset period;

selecting a discharge cell to be turned on during the address period;

supplying a rectangular waveform and a tower waveform to a panel capacitor, the tower waveform having any one of a shape of a sinusoidal waveform, a resonant waveform or a ripple waveform rising from a peak voltage of said rectangular waveform to induce a discharge of the discharge cell, wherein after a voltage level of the rectangular waveform remains substantially constant at the peak voltage for a first predetermined period of time, the tower waveform is simultaneously supplied for a second predetermined period of time to form a combined waveform, the tower waveform causing the combined waveform to have at least one voltage value greater than the peak voltage at which the rectangular waveform remains substantially constant.

16. The method as claimed in claim 15, wherein the discharge cell is discharged when said tower waveform is being supplied.

* * * * *